US005631663A

United States Patent [19]

David et al.

[11] Patent Number: 5,631,663

[45] Date of Patent: May 20, 1997

[54] WALL FOR RADOMES, AND RADOMES THUS OBTAINED

[75] Inventors: Jean-Pierre David, Ermont; Bernard Estang, Chevreuse; Patrice Bossuet, Herblay, all of France

[73] Assignee: Thomson-CSF, Paris, France

[21] Appl. No.: 172,115

[22] Filed: Mar. 11, 1988

[30] Foreign Application Priority Data

Apr. 14, 1987 [FR] France ..... 87 05265

[51] Int. Cl.[6] ..... H01Q 1/42

[52] U.S. Cl. ..... 343/872

[58] Field of Search ..... 342/1, 2; 343/872

[56] References Cited

U.S. PATENT DOCUMENTS

| | | | |
|---|---|---|---|
| 4,506,269 | 3/1985 | Greene | 343/872 |
| 4,725,475 | 2/1988 | Fiscus et al. | 343/872 |

FOREIGN PATENT DOCUMENTS

| | | |
|---|---|---|
| 0067946 | 5/1982 | European Pat. Off. . |
| 633943 | 12/1949 | United Kingdom . |
| 846037 | 8/1960 | United Kingdom . |
| 896672 | 5/1962 | United Kingdom . |
| 2075269 | 11/1981 | United Kingdom . |

*Primary Examiner*—Theodore M. Blum

*Attorney, Agent, or Firm*—Pollock, Vande Sande & Priddy

[57] ABSTRACT

The invention relates to walls that are used for constructing radomes, in particular radomes for aircraft radars, as well as radomes using such walls.

According to the invention, the inner and outer layers of said wall are separated by a central core including a central portion made of dielectric material flanked by two lateral portions made of the same dielectric material but with a recess, the aggregate of said portions being obtained by juxtaposition of elemental dominoes.

18 Claims, 3 Drawing Sheets

WALL FOR RADOMES, AND RADOMES THUS OBTAINED

BACKGROUND OF THE INVENTION

1. Field of the Invention

The present invention relates to walls that are used for manufacturing radomes, in particular radomes for aircraft, and radomes using such walls.

2. Description of the Prior Art

Many radar antennas are of the rotary type and undergo disturbances from the outside environment, in particular wind, rain, temperature, etc. In certain applications, these atmospheric disturbances have adverse consequences on the technical performance of radars; for example, the wind can substantially modify the angular velocity of the antenna, which may lead to erratic angular measurements that are incompatible with required accuracy. In the same way, rain water flowing on the surface of the antenna may modify its radio-frequency characteristics to a degree such that the performance of the radar is affected. Thus, in such applications, it is usual to protect the antenna by a dome that is transparent to the radio waves transmitted and received by the radar associated with the antenna.

This protection of the radar antenna of the rotary type by a dome called a "radome" is absolutely necessary for the radars carried by vehicles that moves at high speeds. This is the case of aircraft radars, that are often disposed at the front end of the aircraft in hollow volumes in the form of cones, rectilinear or ogival. These radomes must be designed to resist the very significant mechanical and thermal stresses while retaining their radio-frequency properties. These radio-frequency properties or characteristics are essentially the following:

- a good radio-frequency transparency so as to limit the loss of energy of the transmitted and received waves during their passage through the wall of the radome;
- a low distortion of the antenna beam, which distortion must be reproducible from one radome to another, and
- a low reflection level of the incident wave.

It is easy to compensate for the distortion of the beam, that is mainly characterized by a deflection of the axis of the beam, by offsetting the axis at the radar itself provided, of course, that this deflection is the same from one radome to another. For a radome wall with a given structure, the reproducibility is related to the quality of manufacturing of the wall and not to the composition of its structure.

On the other hand, for both other essential characteristics, namely radio-frequency transparency and reflection of the incident wave, the structure of the wall is very significant.

For aircraft radomes, the structures used are often monolithic. They consist of a layer of dielectric material. The thickness of this layer is, for a good operation, close to a whole multiple of half the wavelength in the dielectric. Such structures have the major disadvantage that the corresponding radomes have a bandwidth of about 3 to 5%, whereas modern radars require a bandwidth wider than 10%.

It is well known that a structure made up of several layers of dielectric material allows an increase in the operating bandwidth of the wall. For example, a structure made up of five dielectric layers will comprise a center layer or core, two intermediate layers having a spacer dielectric role and two end layers or "skins", one inside the radome and the other outside. The index of refraction of the central layer and of the skins is greater than that of the intermediate layers, while the thickness of the central and intermediate layers is greater than that of the end layers. Such structures with five layers are difficult to manufacture in a precise and reproducible manner over the whole surface of the radome due, for one, to the number of layers and, for another, to the precision with which the intermediate layers of foam or honeycomb must be machined, formed to shape and assembled.

SUMMARY OF THE INVENTION

An object of the present invention is the construction of a new wall structure that allows building a radome having a bandwidth twice to three times wider than that obtained with the structure of the prior art.

A further object of the present invention is the construction of a new wall structure whose utilization For building a radome is easier, with respect both to machining of the layers and to their assembly.

The main object of the present invention is a radome wall, that comprises two end layers of dielectric material, one inside the dome and the other outside, these layers are separated by a central core made up of a plurality of unit elements made of dielectric material.

More precisely, each unit element comprises a central portion made of a First dielectric material having an equivalent dielectric constant that is substantially equal to that of the dielectric material of the outer layers and two lateral portions made of a second dielectric material having an equivalent dielectric constant that is low compared to that of the dielectric material of the end layers.

According to the present invention, the first and second dielectric materials are identical, the different values of the dielectric constant being obtained by using different volumes resulting from recesses made in the lateral portions.

The central portion of each unit element has the general shape of a brick with the two main sides which carry the lateral portions and four lateral sides which are plane surfaces whose intersections are rectilinear edges.

In order to facilitate the assembly of the unit elements on the surface of a radome with a conical or ogival shape, the four lateral sides of the central portion are curved surfaces whose intersection with the plane surfaces of the main sides that carry the lateral portions of the unit element are curved edges.

In a preferred embodiment of the lateral portions of the unit element, these portions have the shape of a chimney resting on the main sides of the central portion. The cross sections of the chimney may have various shapes.

The thickness of the central portion as well as that of the lateral portions that determine the spacing between the end layers, varies according to the position of the unit element on the surface of the radome with respect to that of the antenna of the radar with which the radome is associated.

In order to facilitate the utilization of the unit elements on the radome, each central portion is provided with a hole in which a thread is threaded so as to chain the unit elements and to dispose them on the radome along successive helix turns.

Other features and advantages of the present invention will become apparent from the following detailed description of a preferred embodiment given with reference to the accompanying drawings, in which.

DESCRIPTION OF A PREFERRED EMBODIMENT

Figure 1:
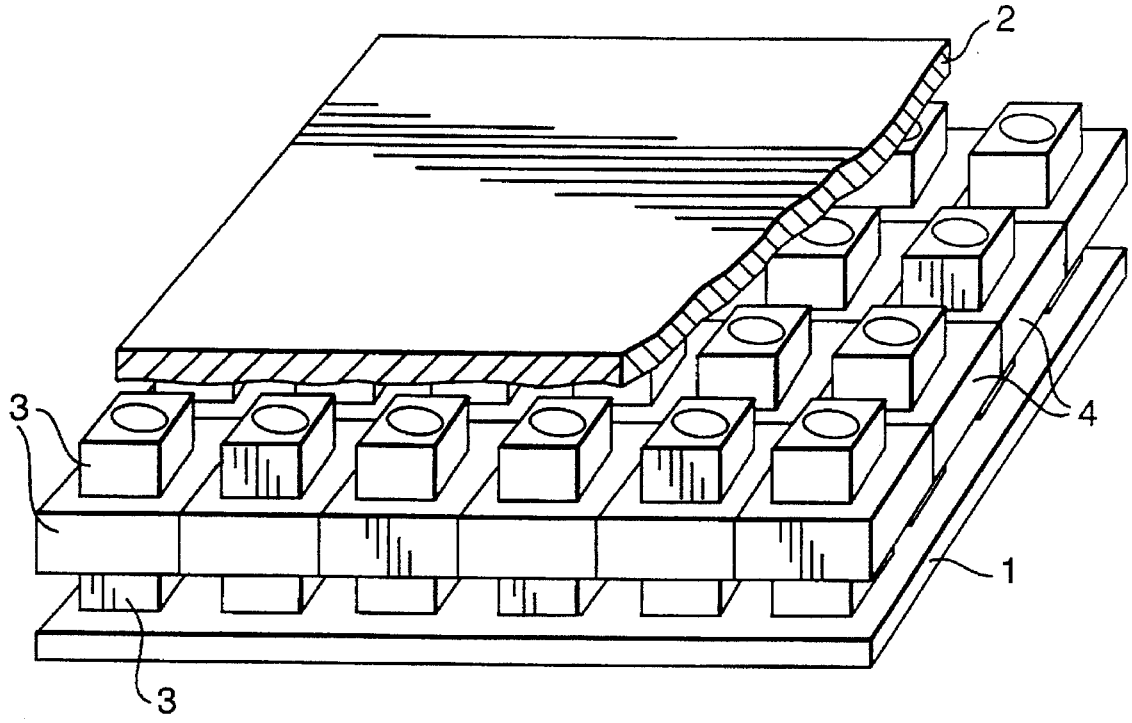
FIG. 1 is a perspective view, partially cut out, of a plane wall for a radome according to the present invention.

A wall for a radome according to the present invention comprises (FIG. 1) two end layers or "skins", one inner layer 1 and one outer layer 2, made of dielectric material. The layers 1 and 2 are constructed in conventional manner using a laminated material through molding, possibly followed by machining. Both end layers 1 and 2 are separated from each other by a central core 3 also made of dielectric material that is made up of a plurality of unit elements 4 shaped as dominos and juxtaposed side by side.

Each unit element 4 comprises (FIGS. 2 and 3) a central portion 5 flanked by two lateral portions 6 and 7. The central portion 5, usually solid, has the shape a brick whose main sides 13 and 14 carry the lateral portions 6 and 7 and whose lateral sides 8, 9, 10 and 11 may be curved and bulging. This central portion 5 is made of a dielectric material whose dielectric constant has a value close to that of the constant of the dielectric of the end layers 1 and 2. In the case where the central portion 5 is not solid, in particular when it exhibits a hole 12 whose use will be described later, the dielectric constant will be computed taking into account the presence of this hole and the value obtained will be an equivalent value of the dielectric constant.

Figure 4:
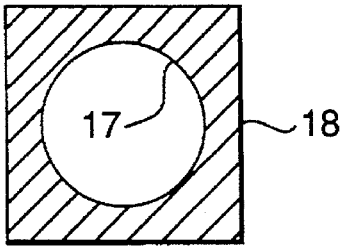
FIG. 4 is a cross-sectional view along the line IV—IV of FIG. 2 of a unit element of the central core of the wall for a radome according to the present invention.
Figure 5:
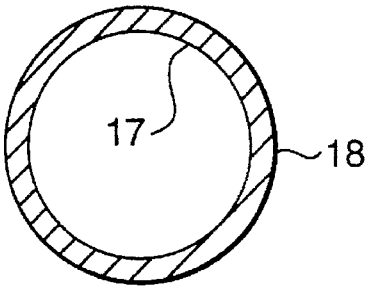
FIG. 5 is a cross-sectional view of a unit element of the central core of the wall for a radome according to the present invention, as seen in a cross-section corresponding to another possible shape of a lateral portion of the central core.

Each lateral portion 6 or 7, disposed on a main side 13 or 14, respectively, of the central portion 5, is in fact an extension of this central portion in which some dielectric material has been removed so as to obtain an equivalent value of the dielectric constant that is lower than that of the central portion 5 and of the end layers 1 and 2. After removal of the dielectric material, the lateral portions 6 and 7 can have various shapes such as that shown in cross-sectional view only in FIGS. 4 and 5. In both cases, the general shape is that of a chimney having a cylindrical inner wall 17 with a circular cross-section whereas the outer wall 18 has a square or rectangular cross-section (FIGS. 2, 3 and 4) or possibly a circular cross-section (FIG. 5).

Figure 2:
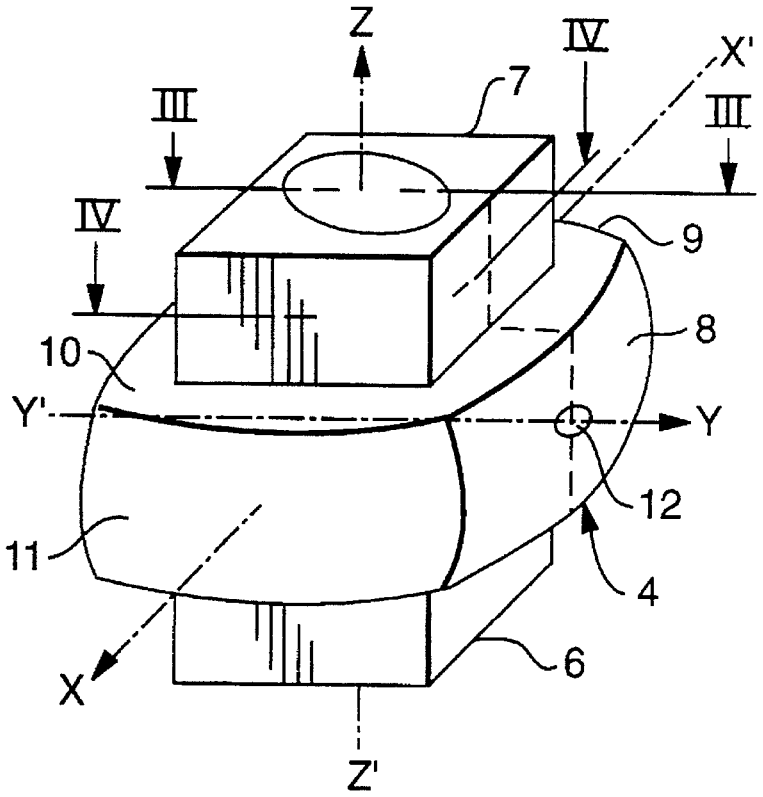
FIG. 2 is a perspective view of a unit element of the central core of the wall for a radome according to the present invention.
Figure 3:
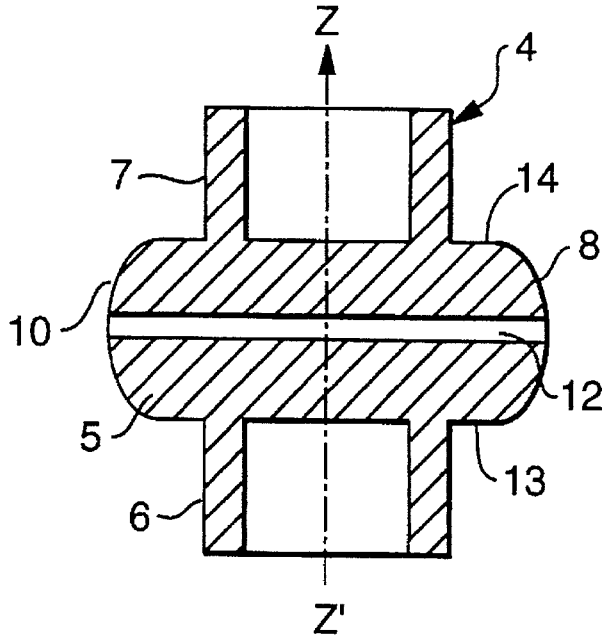
FIG. 3 is a sectional view along the line III—III of FIG. 2 of a unit element of the central core of the wall for a radome according to the present invention.

In FIGS. 2 and 3, the unit elements 4 have the shape of a brick with lateral sides 8 to 11 curved and bulging, but it is clear that these lateral sides can be straight (FIG. 1), concave or a mix of the various above shapes to take into account, for example, the constraints of their assembly on the surface of the radome, that can be conical or ogival or another shape. Also, the various main and lateral sides of the central portion 5 are in general, if the curvature and the bulging are left out of account, squares or rectangles but these shapes may be slightly modified according to the position of the unit element on the surface of the radome.

Generally speaking, the intersections of the main sides 13 and 14, for one, and of the lateral sides 8 to 11, for another, are edges that can be all rectilinear or all curved or possibly some rectilinear and others curved.

The dimensions of each unit element, in particular its thickness along the axis Z'Z, depend on several factors that are mainly the transmission wavelength of the radar, the dielectric constant of the material used and the mean angle of incidence, on this element, of the wave transmitted by the radar. This mean angle of incidence depending, of course, on the position of the unit element of the radome with respect to the radar antenna. It will be understood that the thickness of the unit element along the axis Z'Z in FIG. 2 is variable according to the position of this element with respect to the radar antenna.

It is important that the dimension of the unit element along the axis of the hole 12, i.e., the axis Y'Y, as well as along the orthogonal axis X'X, be of the order of half the wavelength corresponding to the maximum operating frequency of the radar to take into account the type of assembly of the unit elements 4 that will be described later with reference to FIGS. 6 and 7.

Each unit element 4 can be manufactured individually to the required shapes, dimensions and tolerances through molding, thermoforming or machining. To facilitate their installation during the construction of the radome, it is proposed to chain them by a thread passing through the hole 12, then to wind this chain in successive helix turns 16 (FIG. 6) on the inner layer 1 of the radome 15, then to cover it with the outer layer 2 through pressing to the required thickness.

Figure 6:
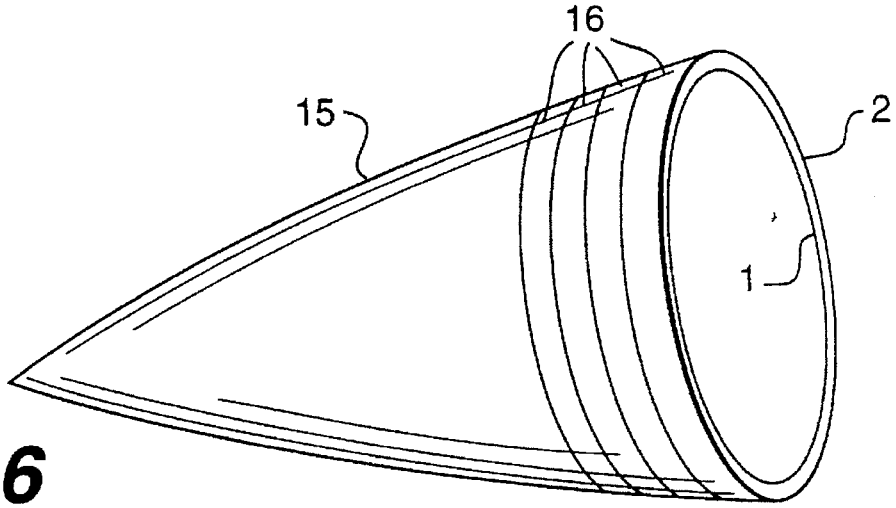
FIG. 6 is a perspective view of a radome with an ogival shape including a wall according to the present invention.
Figure 7:
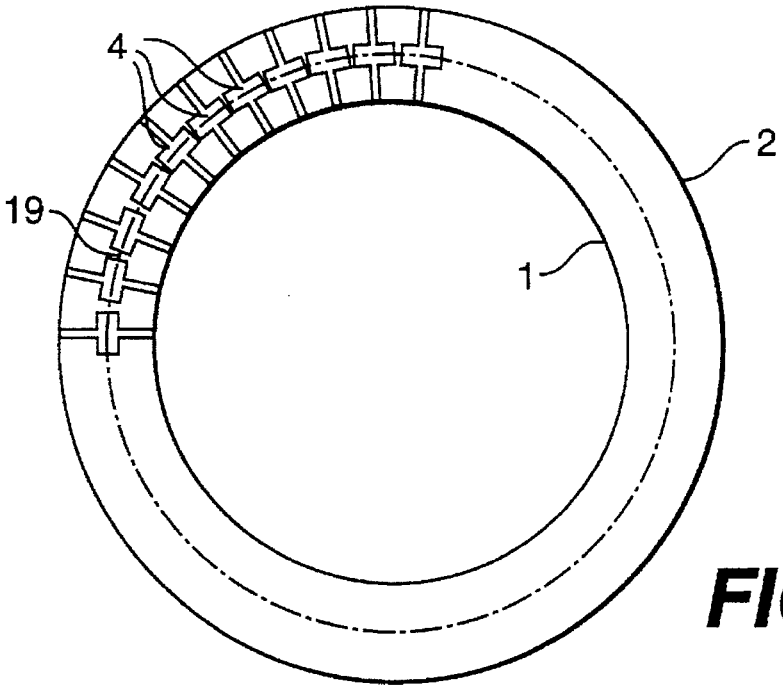
FIG. 7 is an enlarged cross-sectional view of an helix turn of unit elements of the radome of FIG. 6 including a wall according to the present invention.

As shown in FIG. 7, which is a cross-section of the radome 5 of FIG. 6 in the plane of an helix of the chain of unit elements, these unit elements make up a network that receives a radio-frequency radiation, this network having a periodicity equal to the dimensions of the unit element 4 along the axes XX' and YY'. In order to avoid the radio-frequency effects of this network, the dimensions of the unit element along the axes X'X and Y'Y must be of the order of half the wavelength corresponding to the maximum frequency of the radar with which the radome is associated.

As mentioned above, the dimensions of the unit elements 4, in particular their thickness along the axis Z'Z determine the radio-frequency characteristics of the radome 15. Precise control of such dimensions allows the construction a radome whose local thicknesses are well controlled. In this respect, it is to be noted that for manufacturing radomes with multiple dielectric layers in the prior art, attempts to satisfy thickness tolerance on the shape of the radome itself, i.e., tolerances on molding or machining of big volumes, were very difficult to achieve. According to the present invention, the tolerances to be met are those relating to the small-sized unit elements and are consequently easier to meet. In addition, as a consequence, good reproducibility of the characteristics of the radome can be obtained without major difficulty, which is not the case with the fabrication of significant volumes.

The present invention has been described in relation with a preferred embodiment illustrated by the various Figures; however, it is not limited to this embodiment and covers numerous variants in addition to those mentioned, in particular with regard to the shape of the central portion 5 and lateral portions 6 and 7 of the unit elements 4 of the central core 3 of the wall. The same thought applies to the various solutions for assembling the units elements 4 with each other and with the inner layer 1 and outer layer 2, and to the possible effects on the structure of the shape of these unit elements 4, in particular the shape of the lateral sides 8 to 11 and of the central portions 6 and 7 as well as the the presence of absence of holes such that the hole 12.

Another possible variant would be to join together several unit elements to form a brick of higher order. This grouping would reduction in the number of elements to be manufactured and juxtaposed to construct the wall. This solution should be retained if the winding diameter of the helix of unit elements of radome shown in FIG. 7 varies slowly along the generatrix of the radome.

We claim:

1. A wall for a radome, comprising:

two end layers of dielectric material;

a plurality of unit elements of dielectric material arranged between said two end layers for forming a central core, each of said unit elements comprising a central portion having two main sides which are parallelograms connected by lateral sides, said central portion made of a first dielectric material having a first equivalent dielectric constant that is substantially equal to that of said dielectric material of said end layers, and two lateral portions arranged on each main side of said central portion between said central portion and said end layers, respectively, and made of a second dielectric material having a second equivalent dielectric constant that is low compared to that of said dielectric material of said end layers.

2. A wall according to claim 1, wherein said first and second dielectric materials constituting said central and lateral portions, respectively, of said central core are identical, the different values of said first and second equivalent dielectric constants being obtained through different volumes of the single dielectric material.

3. A wall according to claim 2, wherein said central portion is solid and said lateral portions exhibit recesses so as to have a volume of material smaller than that of said central portion.

4. A wall according to claim 2, wherein said central portion is partially hollow and said lateral portions exhibit recesses so as to have a volume of dielectric material smaller than that of said central portion.

5. A wall according to claim 3, wherein said central portion has lateral sides which are surfaces with predetermined curvature.

6. A wall according to claim 4, wherein said central portion has lateral sides which are surfaces with predetermined curvature.

7. A wall according to any of claims 2, 3, 4 or 1, wherein said central portion has four lateral sides which are plane surfaces whose intersections are rectilinear edges.

8. A wall according to any of claims 2, 3, 4 or 1, wherein said central portion has four lateral sides which are curved surfaces, the intersections of these various surfaces being curved edges.

9. A wall according to claim 7, wherein said lateral portions of said central core have each a central hole along a central axis of said unit element perpendicular to said main sides.

10. A wall according to claim 9, wherein an inner wall of said lateral portions deliminting said holes is a cylindrical surface whose directrix is a circle.

11. A wall according to claim 9, wherein an outer wall of said lateral portions is a cylindrical surface whose directrix is a square, a rectangle or a circle.

12. A wall according to claim 8, wherein said lateral portions of said central core have each a central hole along a central axis of said unit element perpendicular to said main sides.

13. A wall according to claim 12, wherein an inner wall of said lateral portions delimiting said holes is a cylindrical surface whose directrix is a circle.

14. A wall according to claim 12 wherein an outer wall of said lateral portions is a cylindrical surface whose directrix is a square, a rectangle or a circle.

15. A wall according to any of claims 2–6 or 1, wherein the thickness of said central core varies according to the position of said unit element on the surface of said radome with respect to that of the antenna of the radar with which said radome is associated.

16. A radome comprising essentially a wall according to any of claims 2–6 or 1.

17. A radome according to claim 16, in which said central portion is partially hollow, wherein said central portion has a hole in which a thread passes so as to chain said unit elements to install them on the inner layer of said radome along successive helix turns.

18. A radome according to claim 17, wherein the length of said hole of said central portion as well as the dimension of said unit element along the axis X'X orthogonal to said hole are of the order of half the wavelength corresponding to the maximum operating frequency of the radar with which said radome is associated.

* * * * *